United States Patent [19]

Schätti

[11] 4,043,219

[45] Aug. 23, 1977

[54] SLIDER FOR AN ANGLE ADJUSTER FOR RECLINING FURNITURE

[76] Inventor: Josef Schätti, Im Tschachen, 8762 Schwanden, Switzerland

[21] Appl. No.: 567,194

[22] Filed: Apr. 11, 1975

[30] Foreign Application Priority Data

Jan. 24, 1975 Germany ..... 2502963

[51] Int. Cl.[2] ..... G05G 5/06

[52] U.S. Cl. ..... 74/536; 5/74; 297/377

[58] Field of Search ..... 5/74, 68, 327; 297/377; 74/126, 142, 128, 536

[56] References Cited

U.S. PATENT DOCUMENTS

| | | | |
|---|---|---|---|
| 2,613,731 | 10/1952 | Roginski | 5/327 B |
| 3,785,215 | 1/1974 | Stefani | 74/142 |

FOREIGN PATENT DOCUMENTS

| | | | |
|---|---|---|---|
| 261,597 | 3/1949 | Switzerland | 5/74 |

*Primary Examiner*—Samuel Scott

*Assistant Examiner*—Wesley S. Ratliff, Jr.

*Attorney, Agent, or Firm*—Larson, Taylor and Hinds

[57] ABSTRACT

An angle or wedge adjuster for reclining furniture is provided with a slide that travels along a rack and which is formed with a cam surface for controlling the position of a strut that engages the rack teeth and is pivoted to a lever, the angle of which is to be adjusted. The movement of the slide is frictionally impeded by a spring-loaded insert located between the slide and a smooth surface of the rack, one of these two sliding surfaces being formed on synthetic plastics material. The spring may be a metal leaf spring bowed downwards to engage a portion of the slide and having its ends sprung against projections that also retain the insert in the slide. Alternatively, this spring may be of synthetic plastics material with its ends made in one piece with the insert of the same material. Conversely, the spring may be bowed upwards with its center integral with the insert. As a further alternative, the insert may be a metal plate coated with synthetic plastics material, and the spring may be a metal leaf spring bowed upwards with its center locked to the plate.

10 Claims, 8 Drawing Figures

SLIDER FOR AN ANGLE ADJUSTER FOR RECLINING FURNITURE

FIELD OF THE INVENTION

The invention relates to a slide for an angle adjuster for use in reclining furniture, wherein the angle of a supported member is adjusted by mechanism, including a support lever, a rack and an interposed strut, and where the mobility of the slide on the rack is impeded by a spring element provided on the slider.

DESCRIPTION OF THE PRIOR ART

Many such slides and angle adjusters are known and used.

It is essential that the spring element impedes the movement of the slide to an exactly defined extent, since the operation of the angle adjuster, especially the operation of changeover from engagement of the strut in the rack to release the strut from the rack, when lowering of the angle adjuster, is dependent thereon.

In known slides a spring element, either a leaf spring of spring steel arranged between slide and rack is provided, or a spring arm pressing against the rack is provided, the spring arm being in one piece with the slide.

In the known slides difficulties arise especially due to the fact that great wear occurs on the spring over lengthy operating times, that fatigue phenomena occur when springs of synthetic plastics material are used which are made in one piece with the material of the slide, or that tilting of the springs makes it difficult to move the angle adjuster.

The use of leaf springs manufactured from spring steel and in direct engagement with the rack has also not proved valuable, since damage frequently occurs due to the rubbing of the spring steel on the metal of the rack.

SUMMARY OF THE INVENTION

The invention is based upon the problem of avoiding the disadvantages of the prior art, that is especially of producing a slide for an angle adjuster for reclining furniture which works reliably and without tilting of the spring element and retains operational reliability even over lengthy operating times.

According to the invention, this is achieved in a simple and economical manner by the fact that the spring acts on the rack by way of two surfaces in sliding contact, at least one of the surfaces being formed on synthetic plastics material. Thus, firstly all inclination to jamming of the slide is avoided and at the same time the wear is reduced to a minimum since on the one hand the spring element can be produced from the material which is the best for its particular function, and in the most expedient form, while due to the provision of synthetic plastics material for the material providing at least one of the sliding surfaces, a correspondingly low-friction material can be used which moreover can be of such configuration, independently of the form of the spring element, that the tendency to jamming is reduced.

The invention can be realised advantageously if in the slide there is provided an insert of synthetic plastics material resiliently forced towards the rack. The side of the insert abutting on the rack can be of such formation that all tendency to tilting is suppressed by preferably flat abutment surfaces between the rack and insert while any desired initial stress and support can be effected by a spring element provided between the insert and the slide.

In this case, leaf springs of spring steel have proved their value, these being initially stressed and engaged with lateral abutments on the insert. This simplifies the operation of fitting a spring, whereupon the insert and the spring can be pushed into the slide. Simple projections can be provided preferably on both ends on the insert as the simplest precaution against lateral shifting of the insert in the operation of the angle adjuster. Other formations for locating the insert in the slide are clearly possible.

The leaf spring may be mounted under stress between the said projections of the insert. Then the leaf spring rests with its curvature on the slide, while the insert bears flatly against the rack. Thus it is ensured that the insert follows any oblique position or tilting of the rack and at the same time in practice rolls on the curvature of the leaf spring. Furthermore by the provision of limiting stops it is possible to ensure that the spring cannot be excessively compressed and thus damaged.

Since in contrast with the slide itself, the insert is hardly subjected to any mechanical loading, it is possible to select a material which permits the one-piece formation of the spring element and the insert from synthetic plastics material. It is also possible to add to the spring action by additional springs, for example of metallic material.

The invention can also be realised with advantage if the spring element is produced from spring steel and provided with a plate of synthetic plastics material or some other material with a synthetic plastics coating located only in the region of contact with the rack.

As may be seen, for the person acquainted with the art a variety of possible variations arises, as for example in the use of spiral springs, in the combination of metallic springs with other material, in the particular formation of the insert and of the slider in order to ensure the proper location of these parts in relation to one another, without thereby departing from the scope of the invention.

As may be seen the inventive content and the technical progress of the object of the application are ensured both by the new individual features and also by the combination and sub-combination of all utilised features.

DESCRIPTION OF THE DRAWINGS

In order that the invention may be clearly understood and readily carried into effect mechanisms in accordance therewith will now be described by way of example, with reference to the accompanying drawings, in which.

Figure 1:
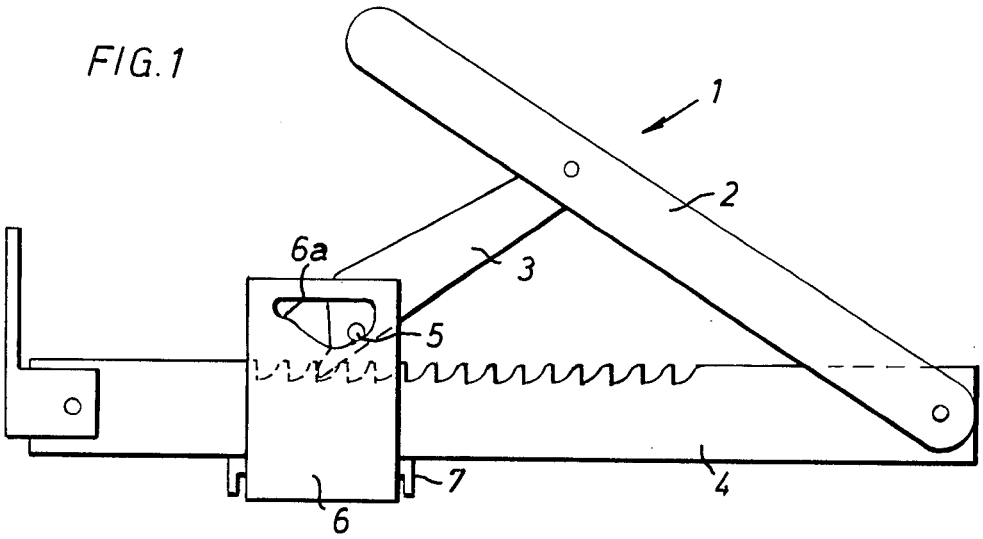
FIG. 1 shows the diagrammatic representation of an angle adjuster with a slide having features of the invention.
Figure 2:
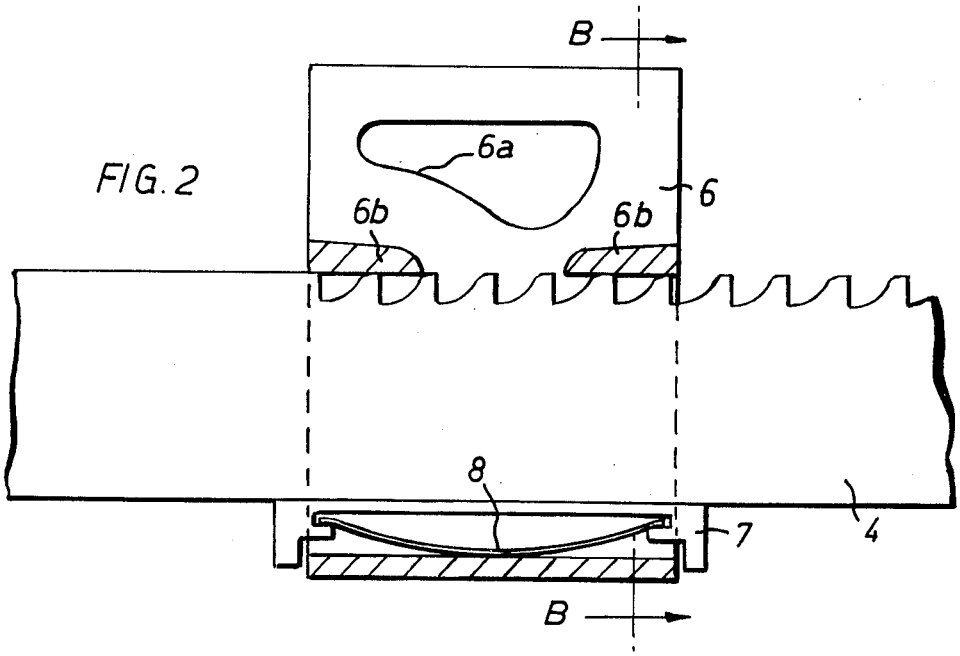
FIG. 2 shows the slide of FIG. 1 on an enlarged scale and in section on the line A—A in FIG. 3.
Figure 3:
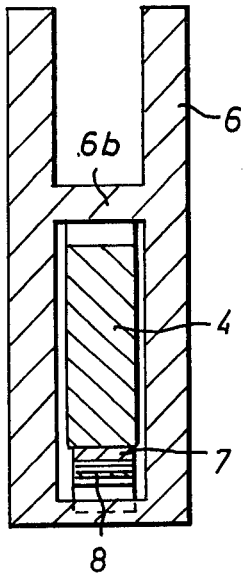
FIG. 3 shows the slide of FIG. 2 in section on the line B—B.

As may be seen from FIGS. 1 to 3, a wedge adjuster 1 has a lever 2 which can be brought by a strut 3, according to choice, to different inclinations in relation to a rack 4.

The strut 3 has projections 5 that engage in known manner in a slide 6 in such a way that when the maximum inclination of the lever 2 is reached the strut 3 comes out of engagement with the rack 4 and thus enables the wedge adjuster 1 to collapse to the lowest position.

The operation of the strut 3 and its co-operation with the rack 4 and a cam face 6*a* in the slide 6 are generally known and therefore will not be explained further.

It is however essential that the slide 6 on the one hand is easily displaceable on the rack 4, but on the other hand is inhibited in motion with a defined force, so that when the highest position of the lever 2 is reached, at which position further movement of the mechanism takes place in the reverse direction, the projections 5 shift on to the highest point of the cam face 6*a* and thus bring the strut 3 out of engagement with the rack 4, without the slide 6 being shifted in such a way as to influence the position of the strut 3.

As may be seen especially from FIGS. 2 and 3, to ensure the stated defined pressure an insert 7 is provided in the slide 6 which is pressed by a leaf spring 8 against the underside of the rack 4 and thus impedes the mobility of the slide 6. Downward movement of the slide 6 is prevented by webs 6*b*.

Despite the fact that forces producing varying turning moments are exerted upon the slide 6 at different points by the strut 3 when the slide is being moved along the rack 4 tilting or jamming between the slide 6 and the rack 4 is avoided due to the co-operation of the leaf spring 8 and of the insert 7, which is pivotable relatively to the slide 6 to remain parallel with the rack 4.

Figure 4:
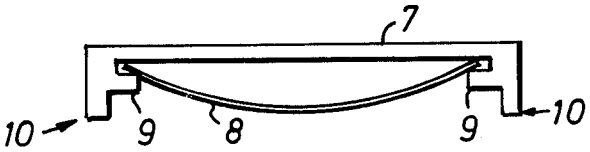
FIG. 4 is an elevation of details appearing in FIGS. 2 and 3.

As may be seen especially from FIG. 4, the insert 7 is pivotable in practice as desired on the apex point of the leaf spring 8. At the same time the arrangement selected in accordance with the invention permits the simplest assembly of the arrangement as follows: Firstly the leaf spring 8 is inserted into the insert 7 and sprung between stops 9. Then the insert 7 provided with the spring 8 is introduced into the slide 6 and located in relation to the slide by projections 10 when the insert 7 is pressed downwards against the force of the spring 8 by the insertion of the rack 4.

Figure 5:
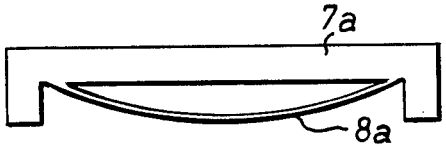
FIGS. 5, 6 and *7a* show elevations of modified forms of the details in FIG. 4; and FIG. *7b* shows a plan of the modified form of FIG. *7a*.

FIG. 5 shows a modified insert 7 which is manufactured from synthetic plastics material and comprises a spring 8*a* formed in one piece in the production operation. The operation of the example shown in FIG. 5 corresponds to that of the example shown in FIGS. 1 to 4, the assembly operation being further simplified.

In the example shown in FIG. 5 as in that of FIG. 4 it is necessary for the material of the insert 7*a* to have good sliding properties. It is also, of course, necessary for the material of the insert 7*a* to have good resilient properties.

Figure 6:
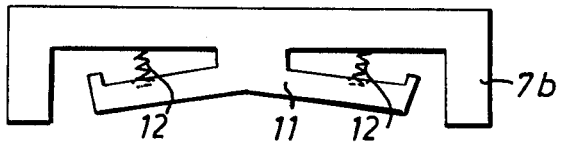

FIG. 6 shows a further modified example in which an insert 7*b* is provided with an elastic shoe 11 which presses against the slide 6 in the assembled condition by way of two spiral springs 12. In this example again the shoe 11 and the insert 7*b* are made in one piece from synthetic plastics material. Moreover in this case introduction of the springs 12 is possible before the assembly of insert 7*b* and slide 6.

Figure 7A:
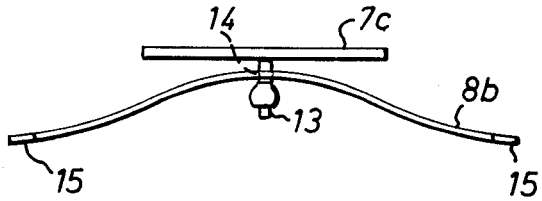
Figure 7B:
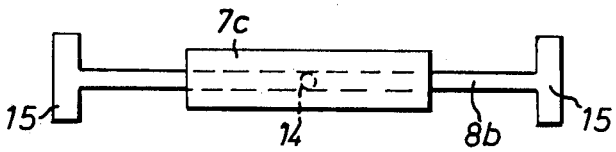

FIGS. 7*a* and 7*b* show a spring 8*b* of spring steel on which a synthetic plastics insert 7*c* is fitted. The assembly of the insert 7*c* and spring 8*b* can be achieved especially simply by insertion of a pin 13 provided on the insert 7*c* into a bore 14 provided in the spring 8*b*. The adaptation of the insert 7*c* to the surface of the rack 4 in the case of possible tilting of the latter is reliably ensured.

The spring 8*b* has a T-shaped projection at each end and the installation of the spring 8*b* in the slide 6 can be brought about without difficulty if the spring 8*b* is first pushed when in a tilted position into the slide 6 so that the leading T-shaped projection can pass through the opening in the slide and then be turned so that the T-shaped projections 15 on opposite ends of the spring 8*b* locate the spring in relation to the slide 6.

The pin 13 serves at the same time to limit the spring travel and prevent damage to the spring 8*b* by excessive compression. In the same way the stops 9 in FIGS. 1 to 4 act in extreme positions of the slide 6 as travel limiters, but it is also possible to provide separate projections such as studs or stops for the limitation of spring travel.

As may be seen, various further modifications are possible for those acquainted with the art, particularly different spring materials, different geometric formations of the spring and of the insert, or kinematic reversal of the components, without thereby departing from the scope of the invention.

I claim:

1. In an angle adjuster for reclining furniture having firstly a rack with a series of rack teeth along an upper face thereof and a smooth lower face extending substantially parallel to said series of rack teeth, secondly a lever pivoted about a first axis at one end of said series of rack teeth, and thirdly a strut which is pivoted about a second axis to said lever, carries a cam follower member, and is formed at an end remote from said second axis to engage any one of said rack teeth for the adjustment of the angle between said lever and said rack, a slide mounted to slide relatively to said rack and formed with a cam surface engaging said cam follower member for controlling the position of said strut in relation to the improvement comprising said series of rack teeth, said slide having a portion thereof beneath but spaced from said lower face of said rack, and inserted means interposed between said portion and said lower face providing a surface in sliding contact with said lower face and also providing resilient reaction on said slide maintaining said lower face and surface in contact, at least one of said lower face and said surface being formed of synthetic plastics material.

2. In the angle adjuster according to claim 1, said inserted means comprising an insert formed with said surface in sliding contact with said lower face and also formed with projections engaging opposite ends of said portion of said slide to locate said insert in said slide, and a spring interposed between said portion of said slide and said insert.

3. In the angle adjuster according to claim 2, said spring being a metal leaf spring.

4. In the angle adjuster according to claim 2, said spring being a metal leaf spring sprung into position with its ends abutting said projections so as to bow downwards with its central lowermost part bearing against said portion of said slide.

5. In the angle adjuster according to claim 2, said spring being a metal leaf spring sprung into position with its ends abutting said projections so as to bow downwards with its central lowermost part bearing against said portion of said slide, and said projections being formed with stop elements respectively projecting beneath the ends of said leaf spring.

6. In an angle adjuster according to claim 1, said inserted means comprising an insert formed of synthetic plastics material and with said surface in sliding contact with said lower face, and a spring of synthetic plastics material interposed between said insert and said portion of said slide.

7. In the angle adjuster according to claim 6, said spring being an arcuate leaf spring made in one piece with said insert.

8. In the angle adjuster of claim 1, said inserted means comprising a spring interposed between said lower face of said rack and said portion of said slide, and a covering element above said spring providing said surface in sliding contact with said lower face of said rack.

9. In the angle adjuster of claim 8, said covering being a plate presenting said surface of synthetic plastics material, and said spring being a bowed leaf spring interposed between said plate and said portion of said slide, and said plate and said spring being formed with interlocking portions fixing them together at the centre of said bowed spring.

10. In the angle adjuster of claim 1, stop means interposed between said lower face of said rack and said portion of said slide to limit relative movement of said portion towards said rack and thereby the extent of said resilient reaction.

* * * * *